US008028372B2

(12) United States Patent
Watson et al.

(10) Patent No.: US 8,028,372 B2
(45) Date of Patent: Oct. 4, 2011

(54) MOBILE BLOWER/VACUUM DEVICE

(75) Inventors: Finlay Llewyn Watson, New South Wales (AU); Julia Prudhoe, New South Wales (AU); Marc Frederick Lachere Francis, New South Wales (AU)

(73) Assignee: Victa Lawncare Pty Ltd., New South Wales (AU)

( * ) Notice: Subject to any disclaimer, the term of this patent is extended or adjusted under 35 U.S.C. 154(b) by 136 days.

(21) Appl. No.: 12/083,481

(22) PCT Filed: Feb. 28, 2007 (Under 37 CFR 1.47)

(86) PCT No.: PCT/AU2007/000240

§ 371 (c)(1), (2), (4) Date: Aug. 10, 2009

(87) PCT Pub. No.: WO2007/098543

PCT Pub. Date: Sep. 7, 2007

(65) Prior Publication Data

US 2010/0005615 A1 Jan. 14, 2010

(30) Foreign Application Priority Data

Feb. 28, 2006 (AU) ..... 2006901005

(51) Int. Cl.
*A47L 5/14* (2006.01)

(52) U.S. Cl. ..... 15/330; 15/331; 15/405; 241/101.01; 241/101.02

(58) Field of Classification Search ..... 15/330, 15/331, 345, 346, 405; 241/101.01, 101.02; *A47L 5/14*
See application file for complete search history.

(56) References Cited

U.S. PATENT DOCUMENTS

| | | | | |
|---|---|---|---|---|
| 3,491,399 | A * | 1/1970 | Burgoon et al. | 15/351 |
| 3,959,846 | A | 6/1976 | Yasuda | |
| 3,968,938 | A * | 7/1976 | Ruhl et al. | 241/101.1 |
| RE29,139 | E * | 2/1977 | Messner | 56/13.1 |
| 5,381,970 | A | 1/1995 | Bold et al. | |
| 6,009,595 | A | 1/2000 | Leasure et al. | |
| 6,141,824 | A | 11/2000 | Fujiwara et al. | |

FOREIGN PATENT DOCUMENTS

| | | |
|---|---|---|
| DE | 295 10 750 | 9/1995 |
| DE | 196 08 376 | 9/1997 |
| GB | 2 304 549 | 3/1997 |

OTHER PUBLICATIONS

May Kerouach; Supplementary European Search Report; Oct. 29, 2008; 6 pages; European Patent Office.

* cited by examiner

*Primary Examiner* — David Redding
(74) *Attorney, Agent, or Firm* — Wood, Herron & Evans, L.L.P.

(57) ABSTRACT

A blower/vacuum device includes a base supported on wheels. The device (10) has a reservoir (bag) that receives material collected by the device. Mounted on the base is a motor and impeller assembly that draws air inward and delivers the air (with collected material) to the bag. The assembly can also be operated to provide a forward delivery directed air stream.

20 Claims, 6 Drawing Sheets

MOBILE BLOWER/VACUUM DEVICE

TECHNICAL FIELD

The present invention relates to vacuum devices and more particularly but not exclusively to vacuum devices to clear outdoor surfaces.

BACKGROUND OF THE INVENTION

Mobile blower/vacuum devices are typically suspended on the user. That is, the motor and impeller and body of the device is suspended on the user with an elongated tube gripped by the user and directed at material to be drawn into the device. A bag is attached to the device downstream of the impeller so that material collected is delivered to the interior of the bag. The bag is air permeable so as to act as a filter.

It is known in respect of the above devices to alter the attachment of the tube so that the tube is downstream of the impeller so that the device acts as a "blower".

A further modification includes the device having a first tube acting as a suction tube, and a second tube fixed thereto acting as a blower tube. A valve is then actuated to deliver air from the impeller to the blower tube or to the bag.

There is also known mobile vacuum devices that are provided with wheels. They have a base with a motor and impeller, with a duct extending from a forward edge of the device to the impeller, and a second duct extending from the impeller to a bag that stores the collected material.

The abovementioned devices that are suspended on the user are difficult to operate and are tiresome to use due to their weight.

The abovementioned vacuum device that is provided with wheels has the disadvantage that it cannot act as a blower.

OBJECT OF THE INVENTION

It is the object of the present invention to overcome or substantially ameliorate the above disadvantages.

SUMMARY OF THE INVENTION

There is disclosed herein a blower/vacuum device including:

a base to move over a surface to which the device is to cause an airstream to pass over;

at least one wheel fixed to the base to engage the surface to aid a user to move the device over the surface, the wheel having an axis of rotation;

a handle attached to the body and extending away from the body in a direction of extension generally normal to said axis, the handle being adapted to be gripped by the user so that the user may direct the device over said surface by rotation of said wheel;

a motor and impeller assembly to cause air to pass through the device;

a first duct extending to the assembly to deliver air thereto;

a second duct, the second duct extending away from said assembly so as to duct air therefrom;

a reservoir to store material collected by the device;

a third duct, said third duct extending away from said assembly to the reservoir to deliver air thereto together with any material passing through the first duct to the impeller;

a valve downstream of said impeller to direct therefrom to said second duct and/or said third duct; and wherein said first duct has an inlet opening at a forward portion of said base, and said second duct has an outlet opening at said forward portion.

Preferably, said inlet opening faces downward toward said surface.

Preferably, said outlet opening directs air in a forward direction relative to said wheels and handle.

Preferably, said base at least partly defined said first duct.

Preferably, said valve includes a movable valve member and a portion to be gripped by a user to cause rotation of the valve member between a first position connecting the impeller with said second duct, and a second position connecting the impeller with said third duct.

Preferably, said valve member is rotated about a generally upright axis.

Preferably, said wheel is a first wheel, and said device includes a second wheel rotatable about said rotational axis but spaced axially from the first wheel.

Preferably, said device includes a third and a fourth wheel, the third and fourth wheels being spaced from the first and second wheels, the third and fourth wheels being castor wheels to engage said surface.

Preferably, said assembly has a rotational axis that is generally upright.

Preferably, said reservoir is supported by said handle.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
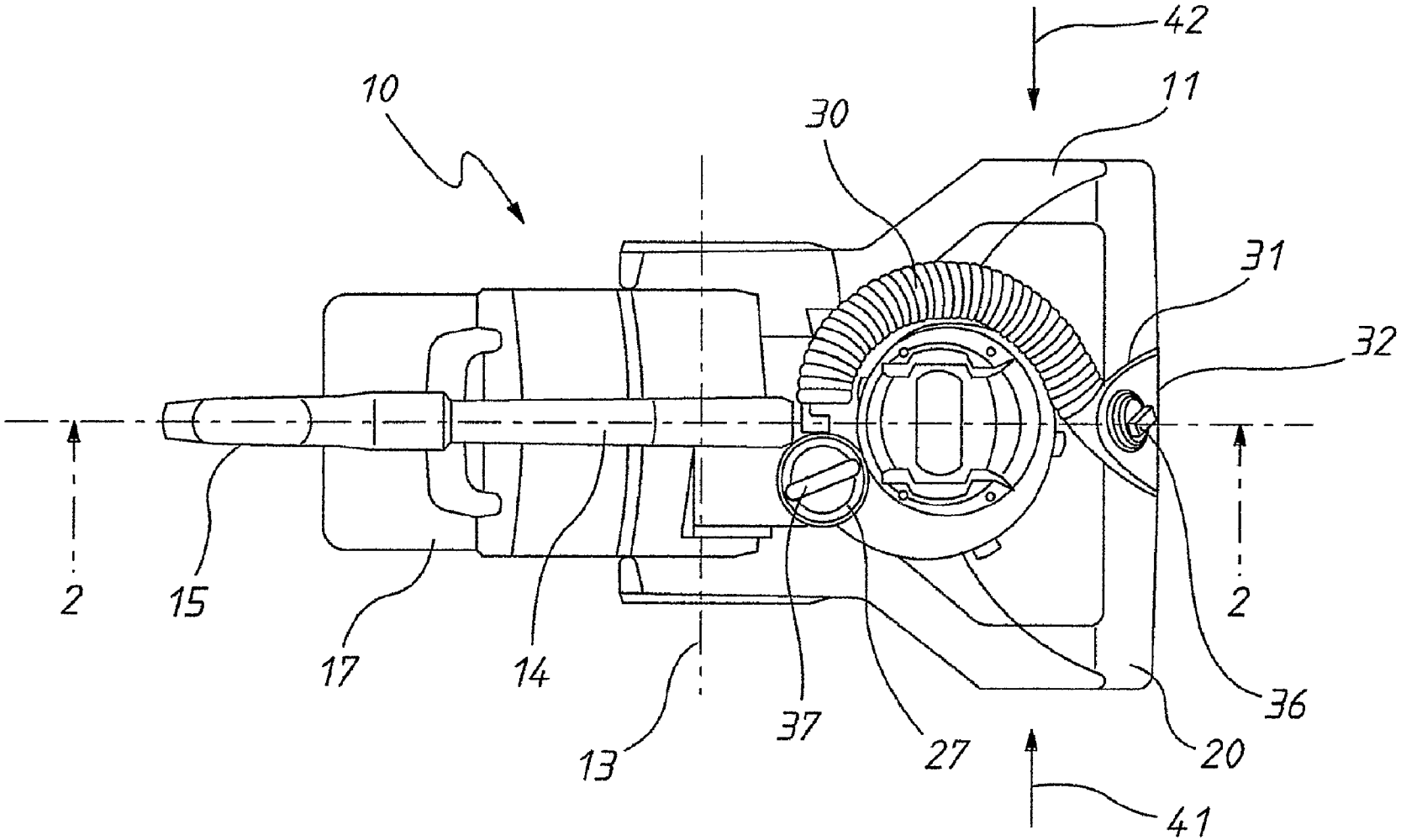
FIG. 1 is a schematic top plan view of a blower/vacuum device.
Figure 2:
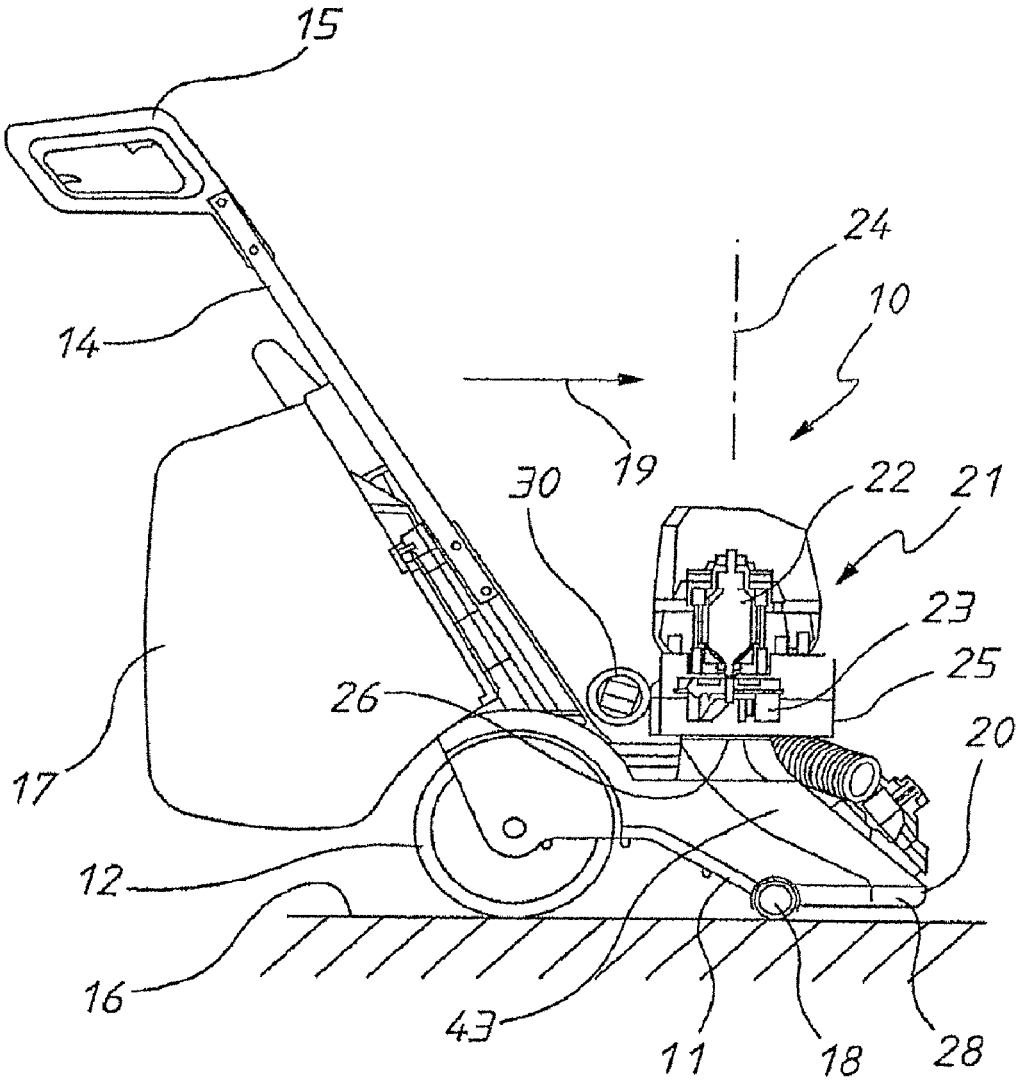
FIG. 2 is a schematic sectioned side elevation of the device of FIG. 1 longitudinally sectioned along the line 2-2.
Figure 3:
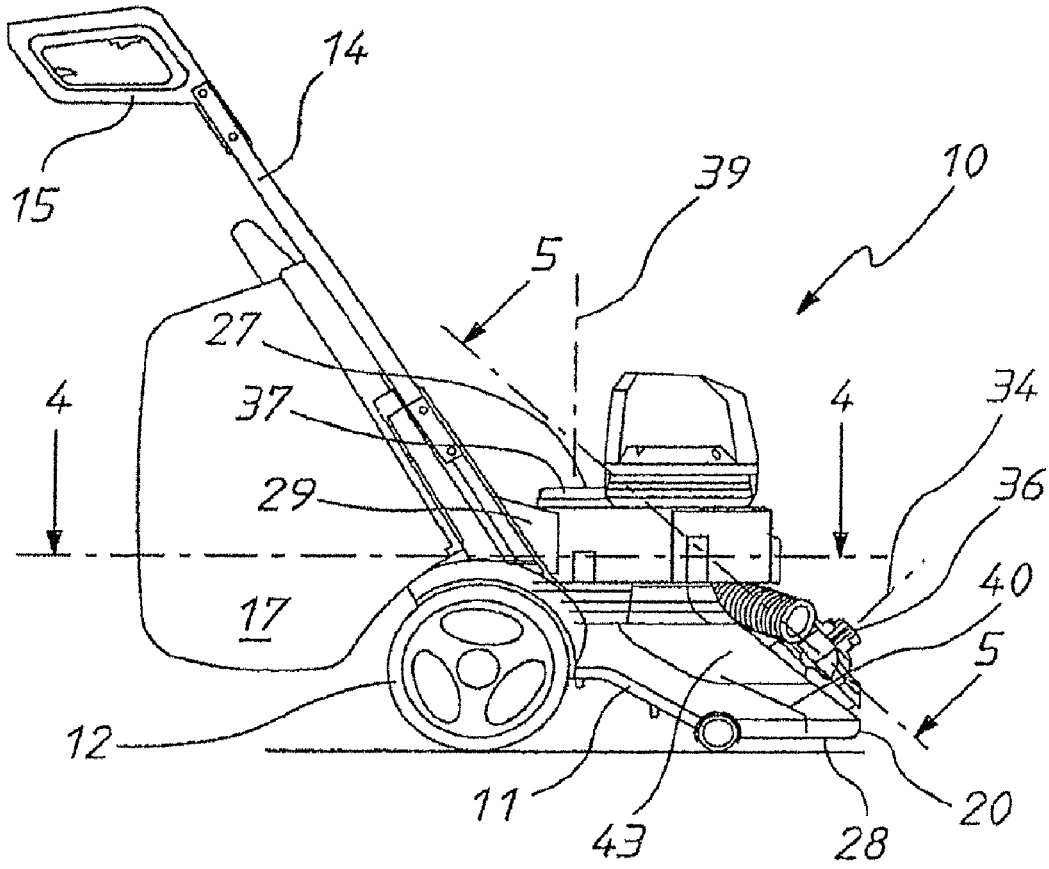
FIG. 3 is a schematic side elevation of the device of FIG. 1.
Figure 4:
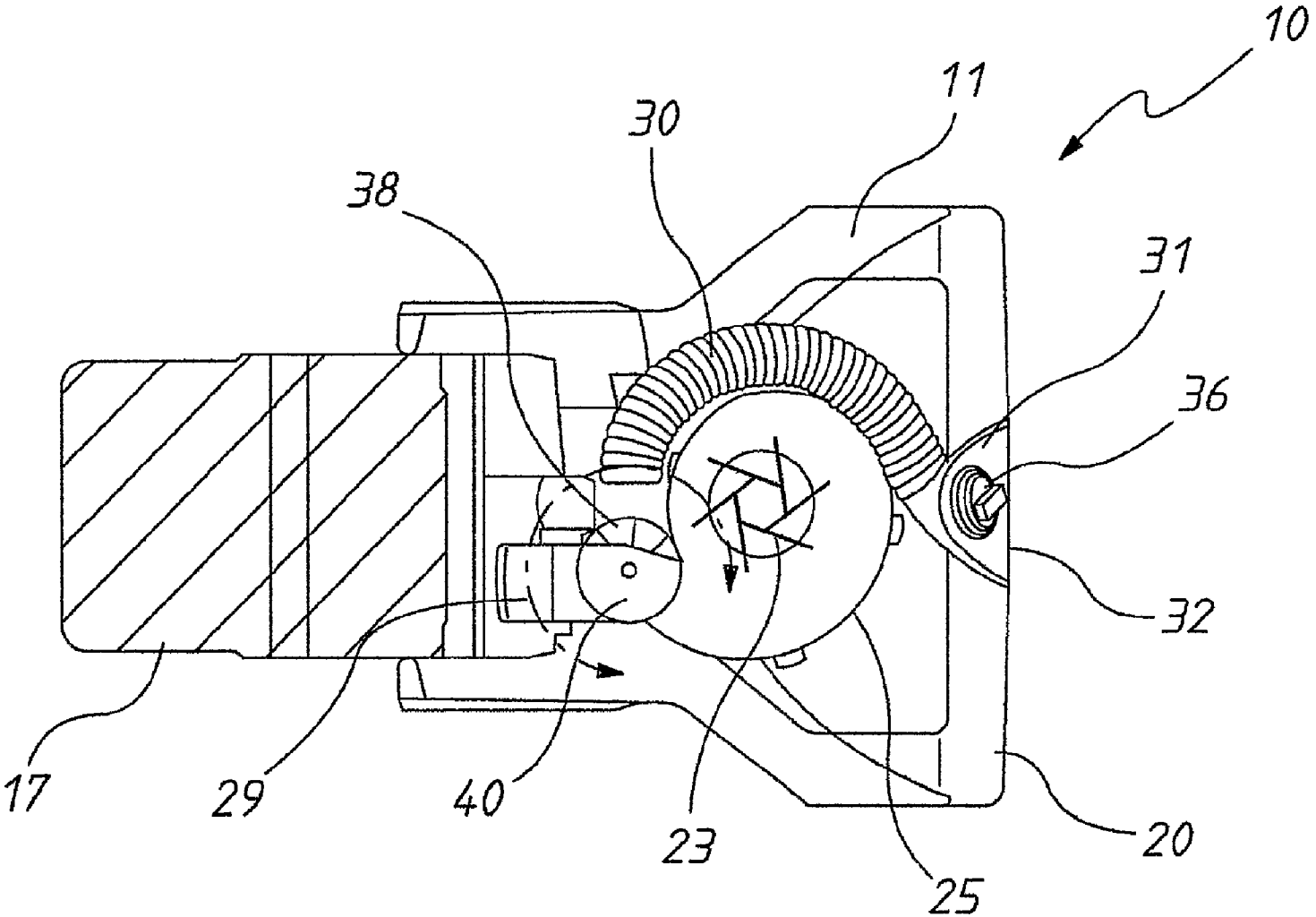
FIG. 4 is a schematic top plan view of the device as shown in FIG. 3 sectioned along the line 4-4.
Figure 5:
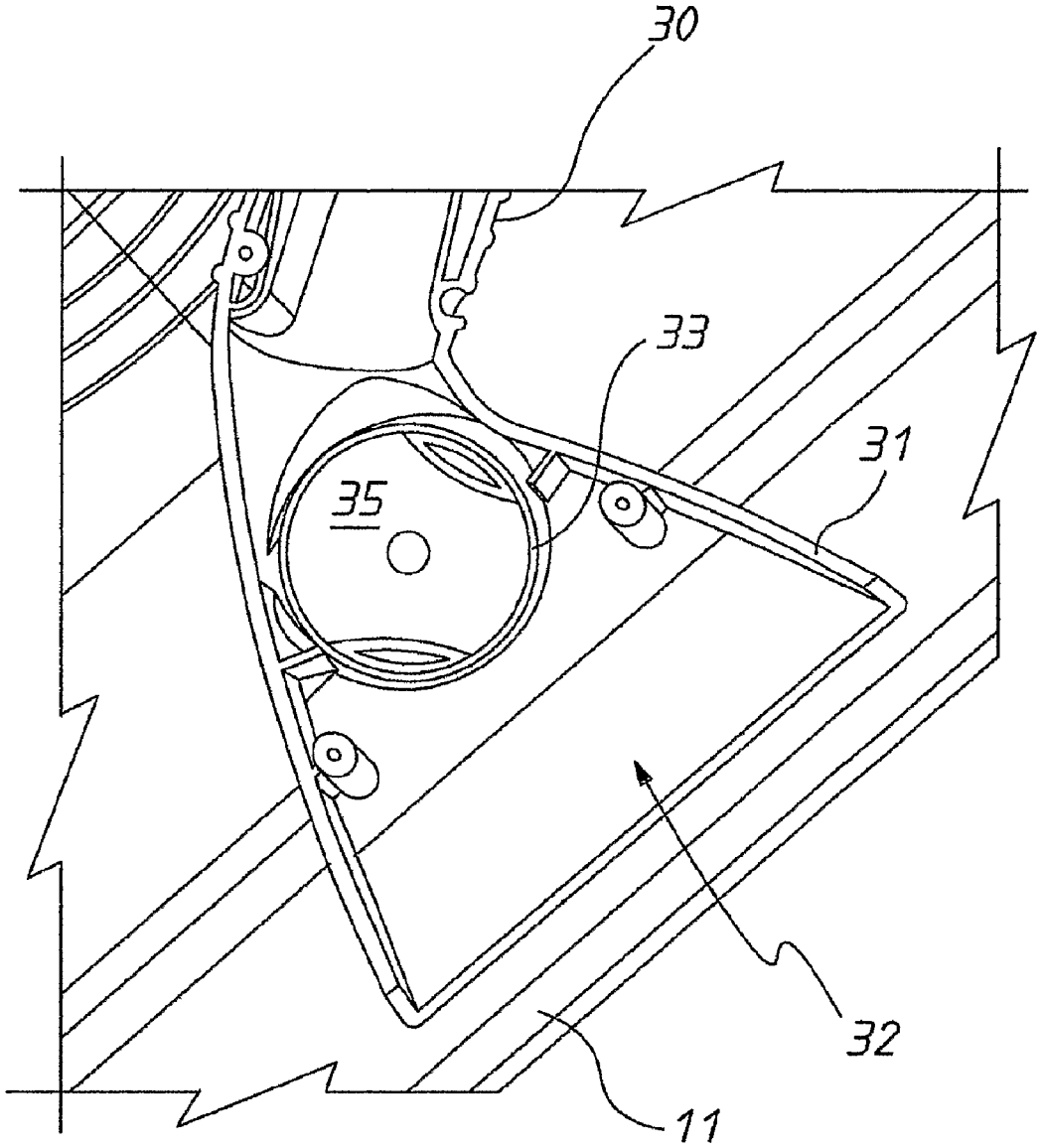
FIG. 5 is a schematic elevation of the device as shown in FIG. 3 sectioned along the line 5-5.
Figure 6:
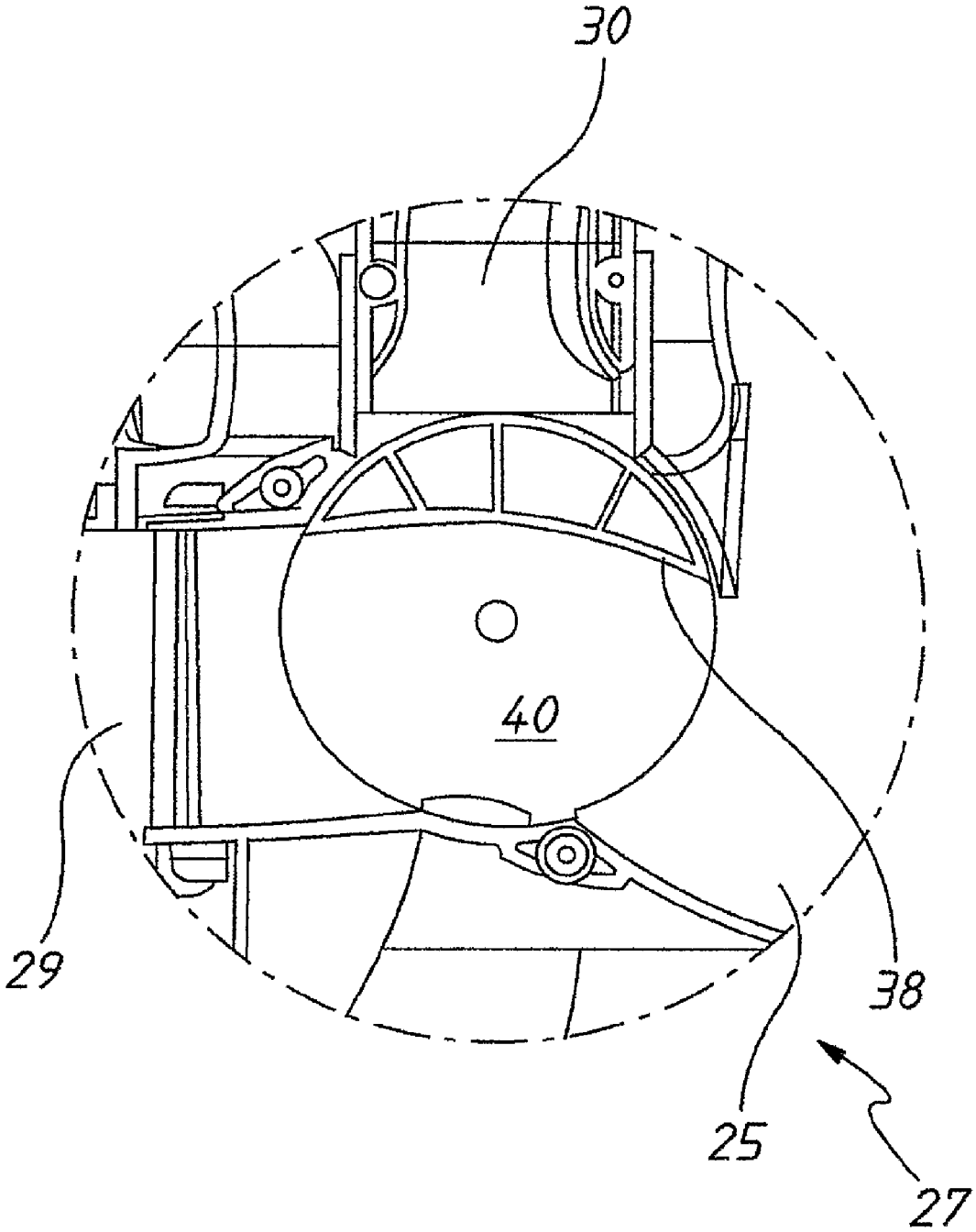
FIG. 6 is a schematic illustration of a valve employed in the device of FIGS. 1 and 3

In the accompanying drawings there is schematically depicted a blower/vacuum device 10. The device 10 includes a base 11 that would be provided with two rear wheels 12 that are rotatable about an axis 13. Attached to and extending upwardly from the base 11 is a handle 14 that extends upwardly from the base 11 at an acute angle relative to the ground surface 16 upon which the device 10 is resting. The upper end of the handle 14 has a portion 15 to be gripped by a user and may include one or more controls.

Attached to and supported by the base 11 and/or handle 14 is a reservoir (bag or container) 17 that receives material collected by the device 10.

The base 11 has a second pair of wheels 18 that are "castor" wheels that also engage the surface 16, so that in combination with the wheels 12 the device 10 may be propelled across the surface 16 by a user gripping the handle 14 and pushing the device 10 in the intended direction of travel. Typically the forward direction of travel would be the direction 19. Accordingly the base 11 has a forward (leading) portion 20 having regard to the forward direction of travel 19.

Mounted on the base 11 is a motor and impeller assembly 21 including an electric (or internal combustion) motor 22 that would be typically provided with electric power by means of a flexible cable. The cable would be operatively associated with the controls on the handle 15 so that a user may select when the motor 22 is operative.

The motor 22 drives an impeller 23, with the motor 22 and impeller 23 having a common generally upright rotational axis 24. The axis 24 is generally normal to the axis 13 although displaced therefrom.

The impeller 23 is located in a housing 25, the housing 25 having an inlet 26 through which air is drawn into the housing 25. The air is caused to rotate by the impeller 23 and is delivered to a valve 27.

Extending to the opening 26 is a first duct 43 that extends to an inlet opening 28 at the forward portion 20. The opening 28 is downwardly facing so as to draw air in from adjacent the surface 16. Accordingly material on the surface 16 is "drawn" into the opening 28 and delivered to the housing 25. The first duct 43 is provided by the base 11, the base 11 consisting of two plastic moulded halves 41 and 42.

Extending from the valve 27 is a second duct 29 that extends to the reservoir 17 so as to deliver air thereto together with any material collected by the device 10. Also extending from the valve 27 is a third duct 30 that extends to a nozzle 31. The nozzle 31 has an outlet opening 32 again adjacent the forward portion 20 so that the opening 32 is adjacent the opening 28. The nozzle 31 directs an airstream down toward the surface 16 at an acute angle relative thereto.

The nozzle 31 includes an airstream direction control device 33 that controls the direction at which air exits the nozzle 31. The device 33 is rotatable about an inclined axis 34, with the device 33 including a passage 35, the position of which may be altered by gripping and turning the knob 36 by moving the knob 36. By changing the position of the passage 35, air exiting the nozzle 31 is changed in direction.

The valve 27 includes a portion 37 that is gripped by a user to select whether air leaving the impeller 23 is directed to the duct 29 or the duct 30. hi particular the valve 27 includes a movable valve member 38 that is angularly movable about the axis 39 to determine whether air is delivered to the duct 29 or the duct 30. The valve member 38 has a passage 40 that is changed in position to direct air to the duct 29 or the duct 30. The axis 39 is generally upright and generally perpendicular to the axis 13 although displaced therefrom.

In operation of the above described device 10, a user may select whether air exiting the housing 25 is delivered to the reservoir 17 so that the device 10 acts as a vacuum device, or to deliver air to the nozzle 31 so the device 10 also acts as a blower.

The above described device 10 has the advantage that should material be missed by the airstream exiting the nozzle 31, that material is drawn into the opening 18 and again exits via the nozzle 31. A further advantage of the above described device 10 is the ability to direct the airstream leaving the nozzle 31.

A still further advantage of the above described device 10 is that the device 10 can be used as a vacuum or blower that is supported on wheels and therefore alleviates problems associated with such devices that are supported by the user.

The invention claimed is:

1. A blower/vacuum device including:

a base to move over a surface to which the device is to cause an airstream to pass over;

at least one wheel fixed to the base to engage the surface to aid a user to move the device over the surface, the wheel having an axis of rotation;

a handle attached to the base and extending away from the base in a direction of extension generally normal to said axis, the handle being adapted to be gripped by the user so that the user may direct the device over the surface by rotation of said wheel;

a motor and impeller assembly to cause air to pass through the device, said assembly having a generally vertical rotational axis;

a first duct extending to said assembly to deliver air thereto;

a reservoir to store material collected by the device;

a second duct, said second duct extending away from said assembly to the reservoir to deliver air thereto together with any material passing through the first duct to said assembly;

a third duct extending away from said assembly;

a valve downstream of said assembly to direct air therefrom to said second duct or said third duct, said valve including a movable valve member that is pivotal about a generally vertical axis to direct the air from said first duct to said second duct or said third duct; and wherein said first duct has an inlet opening at a forward portion of said base, and said third duct has an outlet opening at said forward portion.

2. The device of claim 1, wherein said inlet opening faces downward toward the surface.

3. The device of claim 1, wherein said outlet opening directs air in a forward direction relative to said wheels and handle.

4. The device of claim 1, wherein said base at least partly defines said first duct.

5. The device of claim 1, wherein said valve includes a portion to be gripped by a user to cause the pivotal movement of said valve member between a first position connecting said assembly with said second duct, and a second position connecting said assembly with said third duct.

6. The device of claim 1, wherein said at least one wheel includes a first wheel and a second wheel rotatable about said rotational axis but spaced axially from said first wheel.

7. The device of claim 6, further including a third wheel and a fourth wheel, said third and fourth wheels being spaced from said first and second wheels, and said third and fourth wheels being castor wheels to engage the surface.

8. The device of claim 1, wherein said reservoir is supported by said handle.

9. The device of claim 1, further comprising:

a nozzle including an air stream direction control device that is operable to direct air exiting said outlet opening in a desired direction.

10. The device of claim 9, wherein said air stream direction control device is pivotally movable about an inclined axis to change the direction in which air exiting said outlet opening is directed, said inclined axis being inclined to horizontal.

11. The device of claim 10, wherein said air stream direction control device includes a knob adjacent said air stream direction control device, said knob gripped by a user to cause the pivotal movement of said air stream direction control device.

12. The device of claim 1, wherein said assembly includes a motor and an impeller driven by said motor, with said motor and said impeller being rotatable about the generally vertical rotational axis of said assembly, and said device further includes a housing mounted on said base, said impeller being housed within said housing.

13. The device of claim 5, wherein said portion to be gripped by a user to rotate said valve member is positioned adjacent said base and said valve member.

14. The device of claim 2, wherein said outlet opening directs air in a forward direction relative to said wheels and handle.

15. The device of claim 14, wherein said base at least partly defines said first duct.

16. The device of claim 15, wherein said valve includes a portion to be gripped by a user to cause the pivotal movement of said valve member between a first position connecting said assembly with said second duct, and a second position connecting said assembly with said third duct.

17. The device of claim 16, wherein said at least one wheel includes a first wheel and a second wheel rotatable about said rotational axis but spaced axially from said first wheel.

18. The device of claim 17, further including a third wheel and a fourth wheel, said third and fourth wheels being spaced from said first and second wheels, and said third and fourth wheels being castor wheels to engage the surface.

19. The device of claim 18, further comprising:

a nozzle including an air stream direction control device that is operable to direct air exiting said outlet opening in a desired direction, wherein said air stream direction control device is pivotally movable about an inclined axis to change the direction in which air exiting said outlet opening is directed, said inclined axis being inclined to horizontal, wherein said air stream direction control device includes a knob that is gripped by a user to cause the pivotal movement of said air stream direction control device.

20. The device of claim 19, wherein said assembly includes a motor and an impeller driven by said motor, with said motor and said impeller being rotatable about the generally vertical rotational axis of said assembly, and said device further includes a housing mounted on said base, said impeller being housed within said housing.

* * * * *